US006325672B1

(12) United States Patent
Belopolsky et al.

(10) Patent No.: US 6,325,672 B1
(45) Date of Patent: Dec. 4, 2001

(54) ELECTRICAL CONNECTOR WITH INTERNAL SHIELD AND FILTER

(75) Inventors: Yakov Belopolsky, Harrisburg; William A. Northey, Etters, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/419,734

(22) Filed: Oct. 16, 1999

(51) Int. Cl.[7] ..... H01R 13/66; H01R 33/945; H01R 13/648; H01R 24/00; H01R 33/20

(52) U.S. Cl. ..... 439/620; 439/607; 439/676

(58) Field of Search ..... 439/607, 676, 439/620; 350/331

(56) References Cited

U.S. PATENT DOCUMENTS

| | | | | |
|---|---|---|---|---|
| 2,163,412 | | 3/1939 | Schneider . | |
| 2,476,886 | | 7/1949 | Miller et al. . | |
| 3,728,787 | | 4/1973 | McDonough . | |
| 4,647,122 | * | 3/1987 | Kelly | 439/108 |
| 4,650,723 | | 3/1987 | Furuya . | |
| 4,662,702 | | 5/1987 | Furuya . | |
| 4,859,201 | | 8/1989 | Marsh . | |
| 4,921,430 | | 5/1990 | Matsuoka . | |
| 4,969,842 | | 11/1990 | Davis . | |
| 4,995,834 | * | 2/1991 | Hasegawa | 439/620 |
| 5,016,982 | * | 5/1991 | Fergason et al. | 349/33 |
| 5,035,651 | | 7/1991 | Dixon et al. . | |
| 5,169,321 | | 12/1992 | Matsuoka . | |
| 5,312,273 | | 5/1994 | Andre et al. . | |
| 5,399,107 | | 3/1995 | Gentry et al. . | |
| 5,496,195 | | 3/1996 | Reed . | |
| 5,509,823 | | 4/1996 | Harting et al. . | |
| 5,513,065 | | 4/1996 | Caveney et al. . | |
| 5,531,606 | | 7/1996 | Rodrigues et al. | 439/188 |
| 5,531,612 | | 7/1996 | Goodall et al. . | |
| 5,547,405 | | 8/1996 | Pinney et al. . | |
| 5,564,948 | | 10/1996 | Harting et al. . | |
| 5,571,035 | | 11/1996 | Ferrill . | |
| 5,586,914 | | 12/1996 | Foster et al. . | |
| 5,597,326 | | 1/1997 | DeLessert et al. . | |
| 5,599,209 | | 2/1997 | Belopolsky . | |
| 5,647,770 | | 7/1997 | Belopolsky . | |
| 5,687,478 | | 11/1997 | Belopolsky . | |
| 5,718,606 | | 2/1998 | Rigby et al. . | |
| 5,736,910 | | 4/1998 | Townsend et al. | 333/181 |
| 5,772,472 | | 6/1998 | Beutler et al. | 439/608 |

FOREIGN PATENT DOCUMENTS 2 329 530 A 3/1999 (GB) .

* cited by examiner

*Primary Examiner*—Paula Bradley
*Assistant Examiner*—Edwin A. León
(74) *Attorney, Agent, or Firm*—Steven M. Reiss; M. Richard Page

(57) ABSTRACT

A modular jack connector that includes a conductive outer shield and an inner insulative housing that defines a receiving space into which a complementary connector may be inserted. Contacts are provided in the connector that extend into the receiving space to mate with contacts within the complementary connector and to electrically connect the modular jack connector to a printed circuit board. Disposed between predetermined ones of the contacts within the receiving space are filter elements that are provided to reduce electromagnetic interference effects. The filter elements are adapted to mate with the contacts within the complementary connector. The filter elements may be capacitive filters having a capacitance between approximately 60–100 pF.

19 Claims, 5 Drawing Sheets

ELECTRICAL CONNECTOR WITH INTERNAL SHIELD AND FILTER

CROSS-REFERENCE TO RELATED APPLICATIONS

This application is related to U.S. Patent Application number Ser. No. 09/419,735filed on Oct. 16, 1999, herein incorporated by reference.

BACKGROUND OF THE INVENTION

1. Field of the Invention

The present invention relates to electrical connectors. More specifically, the present invention relates to modular jack receptacles having an internal filter element.

2. Brief Description of Earlier Developments

Modular jacks are used in two broad categories of signal transmission: analog (voice) and digital (data) transmission. These categories can overlap somewhat since digital systems are used for voice transmission as well. Nevertheless, there is a significant difference in the amount of data transmitted by digital systems. A low speed system ordinarily transmits from about 10 to 16 megabits per second (Mbps), while a high speed system may transmit at 155 Mbps or even higher data rates. Often, high speed installations are based on asynchronous transfer mode transmission and utilize shielded and unshielded twisted pair cables.

With recent increases in the speed of data transmission, requirements have become important for electrical connectors, in particular, with regard to the reduction or elimination of crosstalk. Crosstalk is a phenomena in which apart of the electromagnetic energy transmitted through one of multiple conductors in a connector causes electrical currents in the other conductors. Another problem is common mode electromagnetic interference or noise. Such common mode interference is often most severe in conductors of the same length, when a parasitic signal induced by ESD, lightning or simultaneous switching of semiconductor gates arrives in an adjacent electrical node through multiple conductors at the same time.

Another factor which must be considered is that the telecommunications industry has reached a high degree of standardization in modular jack design. Outlines and contact areas are essentially fixed and have to be interchangeable with other designs. It is, therefore, important that any novel modular jack allow the use of conventional parts or tooling in its production with only minor modification.

U.S. Pat. No. 5,513,065, to Caveney et al., discloses a solution to reduce crosstalk in a modular connector. Caveney et al. propose a multilayer capacitive label that is inserted into a recessed region of a modular jack connector proximate to the contacts within the connector. The label is secured to the contacts using a conductive adhesive that capacitively couples one conductor from a first differential pair with another conductor from a second differential pair. A conductive epoxy is used to make an electrical connection between signal conductors and an electrode of the capacitor. However, the solution proposed by Caveney et al. is limited because the capacitive label must be placed in physical contact with the conductors in the connector. As such, this solution provides sufficient results with differential pairs 3/6 and 4/5, but does not work well for other differential pairs.

While the above provides some reduction in crosstalk under limited circumstances, there still remains a need for improvements in the reduction of crosstalk in modular jack connectors. The present invention provides such a solution.

SUMMARY OF THE INVENTION

In view of the above, the present invention, through one or more of its various aspects and/or embodiments is thus directed to an electrical connector having an insulative housing, a conductive shield secured to the housing, a plurality of contacts within the insulative housing, and a filter disposed between predetermined ones of the contacts and engaging the shield.

In accordance with a feature of the present invention, the contacts may have a mating portion for engaging corresponding contacts in a complementary connector and the filter may be disposed between the mating portion of the predetermined contacts.

In accordance with another feature, the filter may comprise a capacitive filter having an inner dielectric layer surrounded by outer conductive layers. One of the outer conductive layers may contact the external conductive shield, and the other of the conductive layers may contact the complementary connector. Also, the capacitive filter may have a capacitance between approximately 60–100 pF.

In accordance with yet another feature, the capacitive filter may also comprise an upper portion and a lateral portion transverse to the upper portion, where the lateral portion includes a contact region that is adapted to contact with a complementary connector. The upper portion may include an angled member extending therefrom, wherein the angled member electrically engages the conductive shield. In addition, the contacts may be formed at a predetermined angle to engage a complementary connector, and the contact region is formed at approximately the predetermined angle. The contact region may comprise a flange. The lateral portion may also define a channel such that the contact region is movable relative to the lateral portion.

In accordance with another aspect of the present invention, there is provided a receptacle connector having a shield that comprises an insulative member that forms a receiving space adapted to receive a complementary plug, a plurality of contacts extending within the receiving space, and a filter disposed between the contacts and extending into the receiving space.

In accordance with a feature of the invention, the filter may comprise a capacitive filter having an inner dielectric layer surrounded by outer conductive layers. One of the outer conductive layers may contact the shield, and the other of the conductive layers may contact the complementary plug structure. The capacitive filter has a capacitance between approximately 60–100 pF.

In accordance with yet another aspect of the present invention, there is provided a receptacle connector adapted to mate with a plug connector. This receptacle connector comprises an insulative housing having an opening for receiving the plug and channels in communication with the opening, a plurality of contacts extending through some of the channels and into the opening, and at least one capacitive filter extending through another of the channels and into the opening.

According to a feature of the invention, a conductive shield is provided that generally surrounds the housing, and the capacitive filter engages the shield. The capacitive filter may reside between adjacent contacts.

Other features of the present invention are described below.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, in which like references numerals represent similar parts throughout the several views of the drawings, it being understood, however, that the invention is not limited to the specific methods and instrumentalities disclosed. In the drawings.

DETAILED DESCRIPTION OF THE PREFERRED EMBODIMENTS

Figure 2:
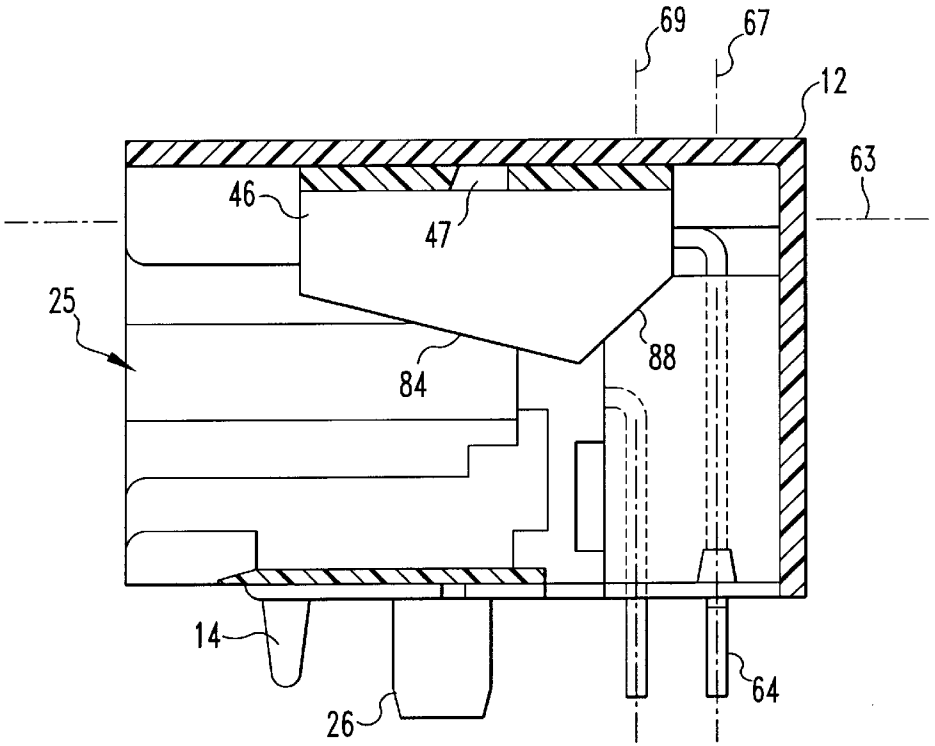
FIG. 2 is a cross sectional view taken through line A—A in FIG. 1.

The filtering of unwanted electromagnetic signals is one of the most common requirements for high speed data transmission. In particular, crosstalk between differential pairs must be suppressed. To achieve this goal, the present invention is directed to an electrical connector, such as a modular jack connector, that includes an internal filter to assure high speed transmission while reducing crosstalk.

Referring now to FIGS. 1–4, there is illustrated a modular jack connector 10 having an external shield 12 made from a suitable conductive material such as copper alloy. This shield 12 may be connected to ground on a printed circuit board (not shown) via a pin 14. The connector 10 includes an insulative housing 16 having a top wall 18, a bottom wall 20 and a pair of opposed lateral walls 22 and 24. The material from which the housing 16 is constructed is preferably a thermoplastic polymer having suitable insulative properties. The walls 18–24 define an interior receiving space 25 that is adapted to received a complementary modular jack plug (not shown). A plastic peg 26 is provided to locate and secure the connector 10 to the printed circuit board in conjunction with a stand-off 42. Housing 16 of the modular jack connector 10 may be unitary or be formed from multiple pieces (e.g., using an insert). Further, modular jack 10 could have either a vertical or horizontal orientation with respect to the printed circuit board.

A group of contacts 28, 30, 32, 34, 36 and 38 (FIG. 1 and FIG. 3) can extend into the interior receiving space 25. The contacts may be connected to the printed circuit board by respective pins 52, 54, 56, 58, 60, 62, 64 and 66 that extend through the bottom wall 20 in the horizontal mount shown in the figures. Predetermined contacts (e.g., 30, 32, 36, 38 and 40, herein "Long Contacts") can extend through the housing 16 in a first plane 67 from the bottom wall 20 until a point proximate to the top wall 18. From there, the long contacts extend toward the front end of the housing 16 in a second plane 68, and then extend downwardly and rearwardly into receiving space 25 toward the rear end of the housing 16 in a first angular plane.

The other contacts (e.g., 28 and 34, herein "Short Contacts") can extend upwardly from the bottom wall 20 of the housing 16 in a second common plane 69 generally parallel to plane 67. Before reaching the top wall 18 of the housing 16, and preferably at a point medially between the bottom wall 20 and top wall 18, the short contacts extend forwardly and upwardly into the receiving space 25 of the housing in a second angular plane. The short contacts in this second angular plane terminate at a forward facing terminal edge. The first and second angular planes are substantially parallel such that the contacts 28, 30, 32, 34, 36, 38 and 40 are properly arranged to mate with contacts provided within a complementary modular jack plug (not shown) that is inserted within receiving space 25.

Figure 1:
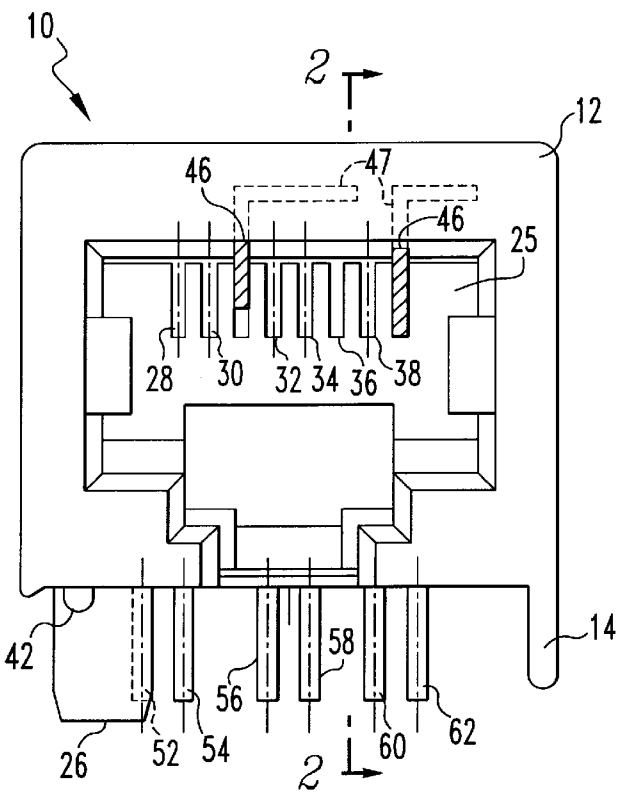
FIG. 1 is a front end view of an embodiment of the modular jack assembly of the present invention.
Figure 3:
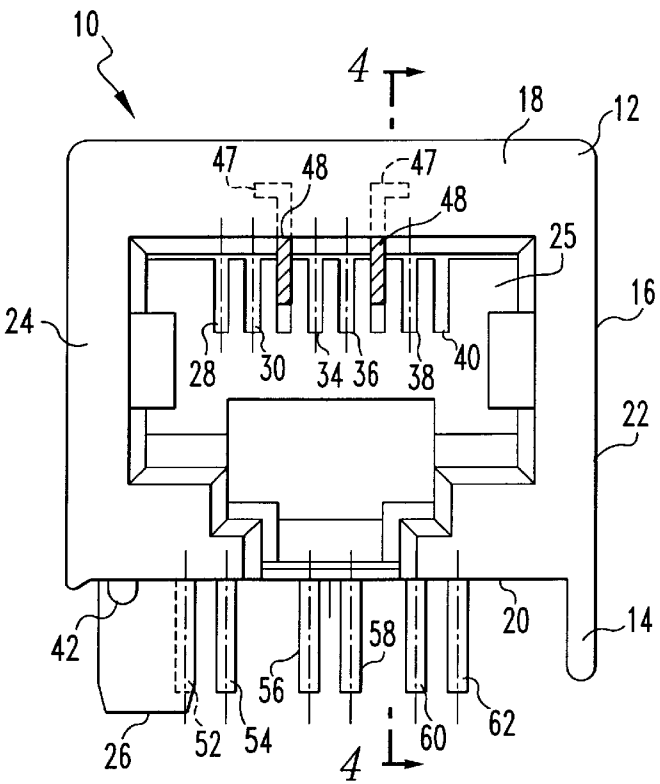
FIG. 3 is a front end view of another embodiment of the modular jack assembly of the present invention.

As illustrated in FIGS. 1 and 3, capacitive filters 46 and 48 are interposed between contacts 28, 30, 32, 34, 36, 38 and 40. In other words, the capacitive filters 46 and 48 occupy an unloaded position within the connector 10 that could otherwise be occupied by a contact. The positioning of filters 46 and 48 helps control crosstalk between predetermined differential pairs. The capacitive filters 46 and 48 are mounted within a receiving space 47 formed in the top wall 18 and are electrically connected to the external shield 12. Similar to the contacts 28, 30, 32, 34, 36, 38 and 40, the capacitive filters 46 and 48 are adapted to mate with contacts provided within the complementary modular jack plug. Various exemplary shapes of capacitive filters 46 and 48 will be described in greater detail below with reference to FIGS. 5–7.

Table 1 illustrates several exemplary configurations of contacts and filters within an eight position connector 10. Other configurations and numbers of contacts and filters will be evident to those of ordinary skill in the art.

TABLE 1

| Contact Position | | | | | | | |
|---|---|---|---|---|---|---|---|
| 1 | 2 | 3 | 4 | 5 | 6 | 7 | 8 |
| S | L | C | L | C | S | L | L |
| L | L | C | L | C | S | L | L |
| L | S | C | L | L | L | L | L |

Note: "C" - Capacitive Low Pass Filter
"L" - Long Contact
"S" - Short contact

Figure 5:
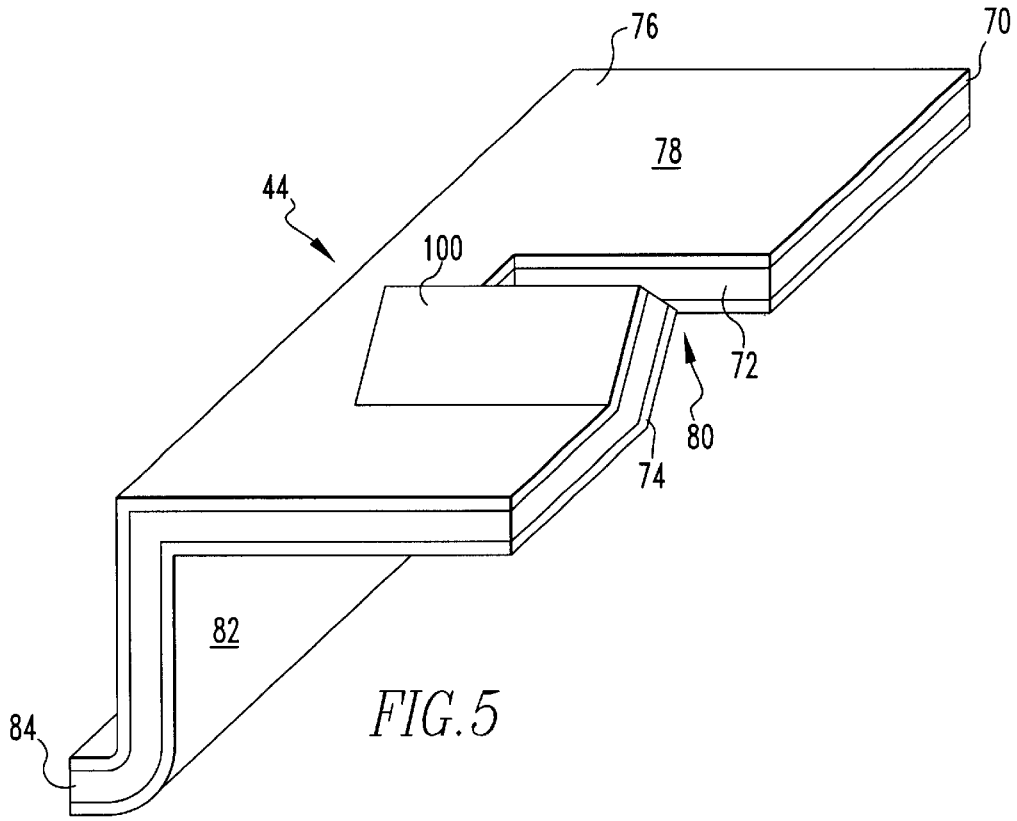
FIG. 5 is a perspective view of an embodiment of a capacitive filter in accordance with the present invention.
Figure 6:
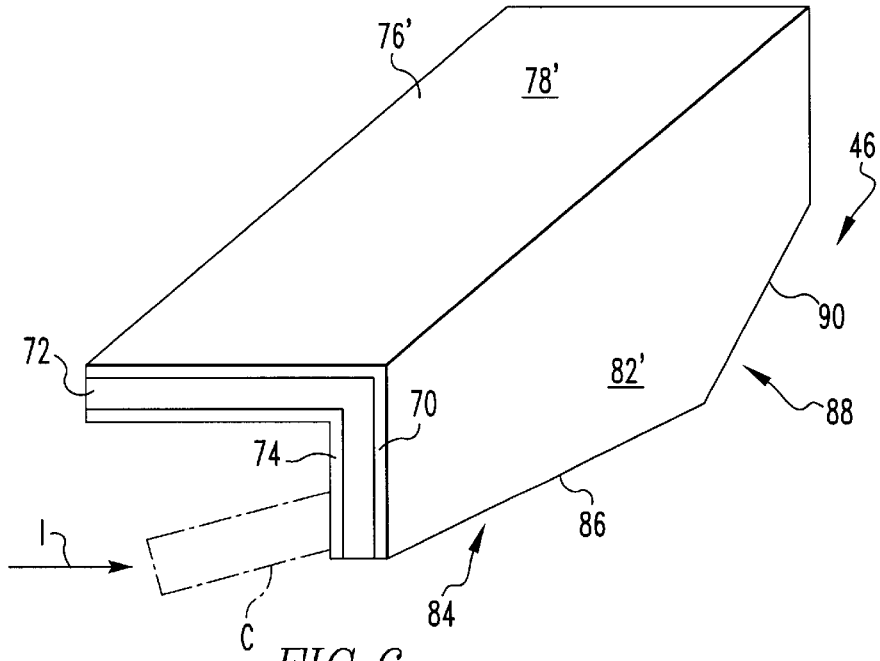
FIG. 6 is a perspective view of another embodiment of a capacitive filter in accordance with the present invention.
Figure 7:
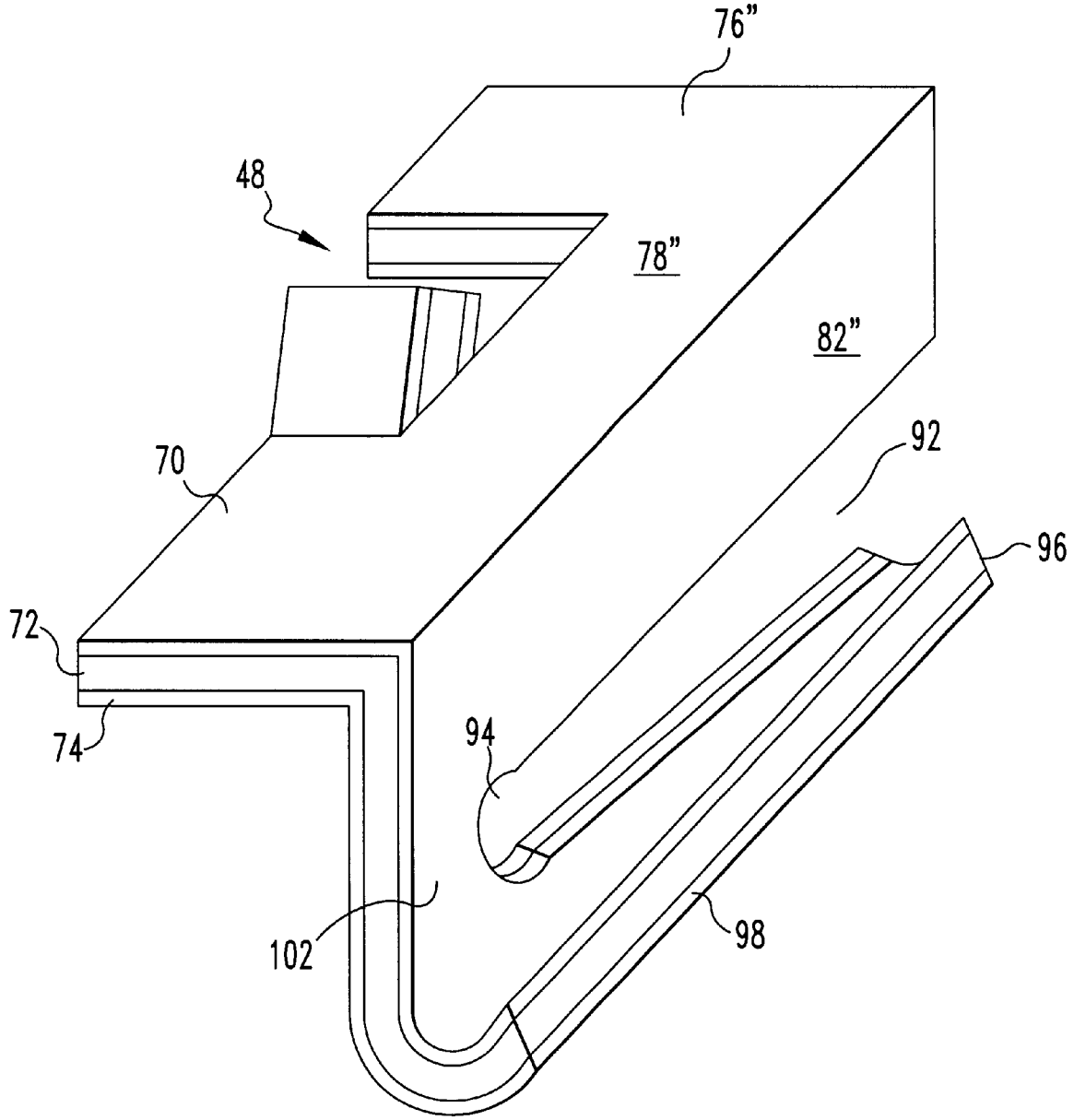
FIG. 7 is a perspective view of yet another embodiment of a capacitive filter in accordance with the present invention.

Referring now to the FIGS. 5–7, there are illustrated several embodiments of the capacitive filter in accordance with the present invention. As shown in FIGS. 5–7, each of the capacitive filters 44, 46 and 48 includes outer conductive layers 70 and 74 which acts as the pads of the capacitor. The outer layers 70 and 74 are separated by an inner layer 72. The outer layers 70 and 74 are preferably comprise a copper alloy (e.g., Phros Bronze) and the inner layer 72 preferably comprises a dielectric, such as polyimide (e.g., DuPont Pyralux®). Preferably, the area of metalization and the thickness of the dielectric are such that the capacitive filter has a capacitance of approximately 60–110 pF. The filters are manufactured using known techniques.

FIG. 5 illustrates an embodiment of the capacitive filter 44 having an elongated body 76. An upper portion 78 includes a cut-out section 80 and an angled member 100 preferably bent up from cut-out section 80. The angled member 100 is provided to resiliently and electrically engage the external shield 12 when the filter 48 is inserted into the receiving space 47 and shield 12 is placed around housing 16. A lateral portion 82 is formed at approximately a 90° angle to the upper portion 78. The portions 78 and 82 each comprise outer layers 70 and 74 separated by the inner layer 72, as noted above. At a lower edge of the lateral portion 82 is preferably formed a flange 84, which is provided to engage contacts on the complementary modular plug.

Referring to FIGS. 2 and 6, there is illustrated another embodiment of the capacitive filter 46. The capacitive filter 46 has an elongated body 76' having an upper portion 78' and a lateral portion 82' that meet at an angle of approximately 90°. As shown in FIG. 2, the elongated body 76' has a length of approximately the depth of the interior receiving space 25. As noted above, the portions 78' and 82' comprise outer layers 70 and 74 separated by an inner layer 72. The lateral portion 82' has a first angled edge 84 formed at a front 86 thereof and a second angled edge 88 formed at a rear 90 thereof. The first angled edge 84 is formed at an angle approximately equal to that formed by the contacts 28, 30, 32, 34, 36, 38 and 40 in the first and second angular planes. Differently than with the other embodiments, a broad side surface of a contact C of a plug connector engages layer 74 as the plug travels along an intersection direction shown by arrow 1.

Figure 4:
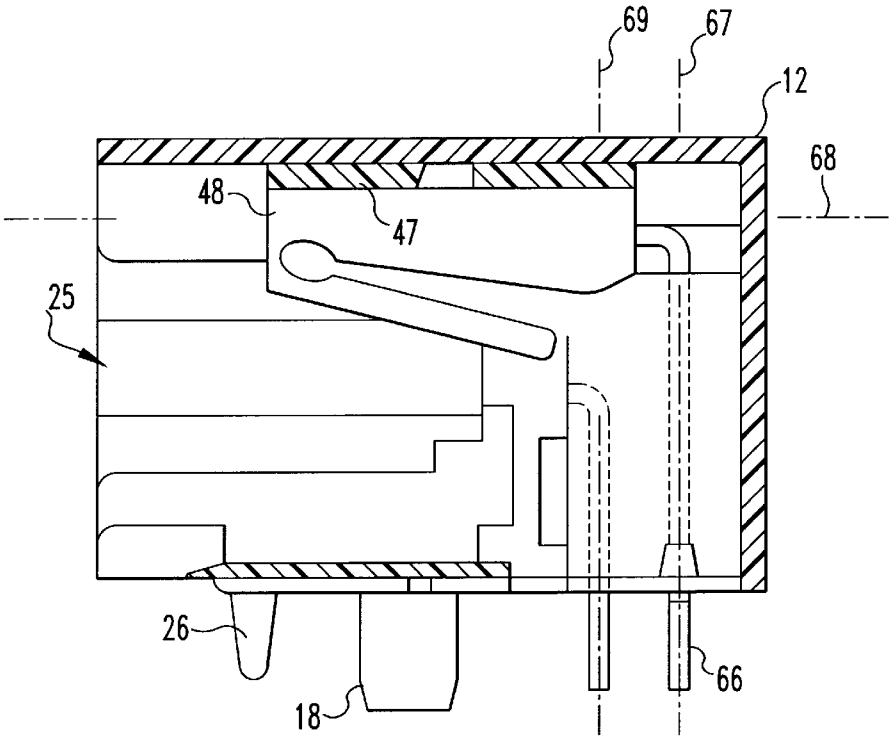
FIG. 4 is a cross sectional view taken through line B—B in FIG. 3.

Referring to FIGS. 4 and 7, there is illustrated another embodiment of the capacitive filter 48. The capacitive filter 48 has an elongated body 76" having an upper portion 78" and a lateral portion 82" that meet at an angle of approximately 90°. As shown in FIG. 4, the elongated body 76" has a length of approximately the depth of the interior receiving space 25. As noted above, the portions 78" and 82" comprise outer layers 70 and 74 separated by an inner layer 72. The lateral portion 82" defines a channel 92 having a circular end 94 such that the lateral portion includes a pivotable lower region 96. The lower region 96 has a contact flange 98 and is preferably formed at an angle approximately equal to that formed by the contacts 28, 30, 32, 34, 36, 38 and 40 in the first and second angular planes. Accordingly, the contact flange 98 may mate with contacts within the complementary modular jack plug. A region indicated generally by reference numeral 102 is shown in FIG. 7. This region 102 is preferably flexible such that when contact is made between complementary modular jack plug and the contact flange 98, a resilient force is created by the lower region 96 similar to a typical contact. This resilient force aids in maintaining a reliable electrical contact between the contact flange 98 and the contacts in the plug.

Figure 8:
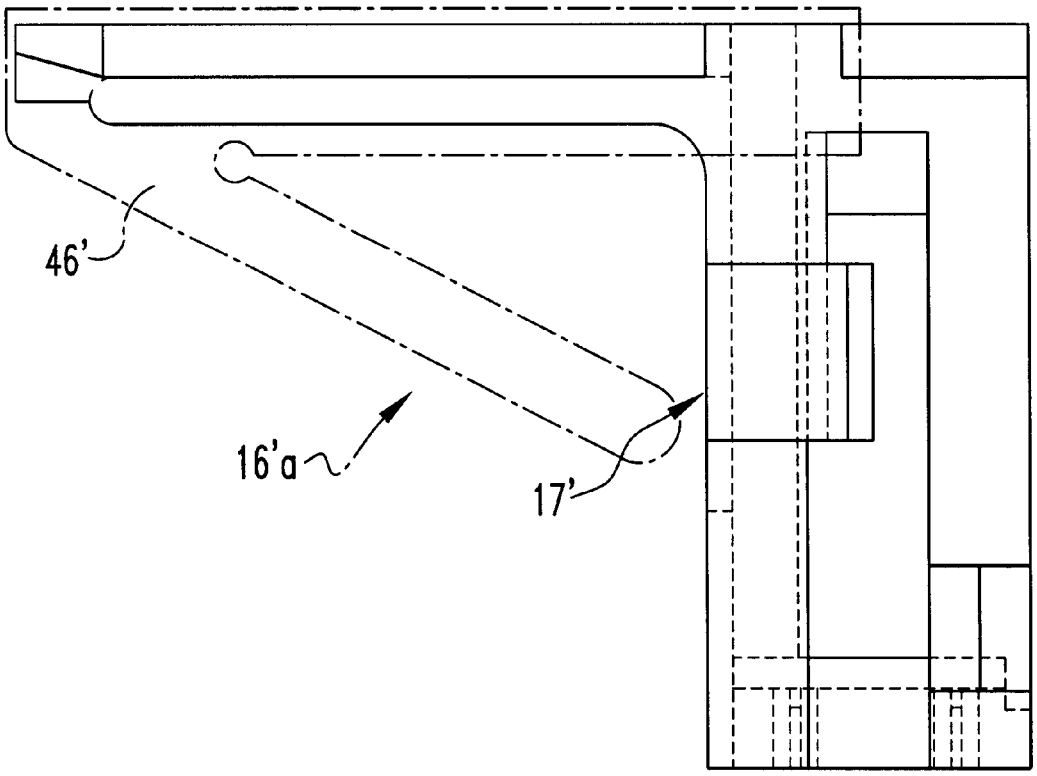
FIG. 8 is a side elevational view of another alternative embodiment of the present invention.

FIG. 8 provides an additional embodiment of the present invention. In this embodiment, the housing has multiple pieces. In particular, an insert **16*a*' caries the contacts and filters 46'. Latches 17' on insert 16*a*' retain insert 16*a*' within the remainder of the housing in a known manner. As with the earlier embodiments, insert 16*a*' can be loaded with contacts and filters 46'** in any arrangement to achieve a desired result. It will be appreciated that there has been described a modular jack receptacle having an internal filtering technique. While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector, comprising:

an insulative housing;

a conductive shield secured to said housing;

a plurality of contacts within said insulative housing; and a filter disposed between predetermined ones of said contacts and engaging said shield, but not physically engaging any of said contacts, and wherein said filter is adapted for physically contacting a complementary mating connector.

2. The electrical connector as recited in claim 1, wherein said contacts have a mating portion for engaging corresponding contacts in a complementary connector, said filter disposed between said mating portion of said predetermined contacts.

3. The electrical connector as recited in claim 1, said filter comprising a capacitive filter having an inner dielectric layer surrounded by outer conductive layers.

4. The electrical connector as recited in claim 3, wherein one of said outer conductive layers contacts said external conductive shield, and the other of said conductive layers contacts the complementary connector.

5. The electrical connector as recited in claim 3, wherein said capacitive filter has a capacitance between approximately 60–100 pF.

6. The electrical connector as recited in claim 3, wherein said capacitive filter comprises an upper portion and a lateral portion transverse to said upper portion, wherein said lateral portion includes a contact region that is adapted to contact with a complementary connector.

7. The electrical connector as recited in claim 6, wherein said upper portion includes an angled member extending therefrom, wherein said angled member electrically engages said conductive shield.

8. The electrical connector as recited in claim 6, wherein said contacts are formed at a predetermined angle to engage a complementary connector, and said contact region is formed at approximately said predetermined angle.

9. The electrical connector as recited in claim 6, wherein said contact region comprises a flange.

10. The electrical connector as recited in claim 6, wherein said lateral portion defines a channel and wherein said contact region is movable relative to said lateral portion.

11. A receptacle connector having a shield, comprising:

an insulative member that forms a receiving space adapted to receive a complementary plug;

a plurality of contacts extending within said receiving space; and a filter disposed between said contacts and extending into said receiving space, but not physically engaging any of said contacts, and wherein said filter is adapted for physically contacting said complementary mating connector.

12. The electrical connector as recited in claim 11, wherein said filter comprises a capacitive filter having an inner dielectric layer surrounded by outer conductive layers.

13. The receptacle connector as recited in claim 12, wherein one of said outer conductive layers contacts said shield, and the other of said conductive layers contacts said complementary plug structure.

14. The electrical connector as recited in claim 13, wherein said capacitive filter has a capacitance between approximately 60–100 pF.

15. A receptacle connector adapted to mate with a plug connector, comprising:

an insulative housing having an opening for receiving the plug and channels in communication with said opening;

a plurality of contacts extending through some of said channels and into said opening; and at least one capacitive filter extending through another of said channels and into said opening, but not physically engaging any of said contacts, and wherein said filter is adapted for physically contacting said plug connector.

16. The receptacle connector as recited in claim 15, further comprising a conductive shield generally surrounding said housing, said capacitive filter engaging said shield.

17. The receptacle connector as recited in claim 15, wherein said capacitive filter resides between adjacent contacts.

18. An electrical connector adapted for engaging a mating connector having a plurality of first contacts, said electrical connector comprising:

an insulative housing;

a conductive shield secured to said housing;

a plurality of second contacts within said insulative housing; and a filter disposed between predetermined ones of said second contacts and engaging said shield wherein when said mating connector engages said electrical connector said filter physically contacts one of said first contacts.

19. An electrical connector, comprising:

a housing;

a plurality of contacts in said housing, said plurality of contacts arranged so as to provide at least one unused contact position therebetween;

a conductive shield secured to said housing; and a filter engaging said shield and residing in said unused contact position.

* * * * *